United States Patent [19]

Guest

[11] 4,356,680

[45] Nov. 2, 1982

[54] METHOD OF APPLYING CLOSURES TO CONTAINERS

[75] Inventor: John H. Guest, Sutton Coldfield, England

[73] Assignee: Metal Closures Limited, England

[21] Appl. No.: 225,063

[22] Filed: Jan. 14, 1981

Related U.S. Application Data

[63] Continuation of Ser. No. 42,409, May 25, 1979, abandoned.

[30] Foreign Application Priority Data

May 31, 1978 [GB] United Kingdom ..... 25108/78

[51] Int. Cl.[3] ..... B67B 3/18; B65B 7/28; B65B 61/18

[52] U.S. Cl. ..... 53/412; 53/422; 53/488

[58] Field of Search ..... 53/412, 422, 488, 334, 53/129, 130, 133, 33, 488, 421, 338, 339, 340

[56] References Cited

U.S. PATENT DOCUMENTS

| | | | |
|---|---|---|---|
| 798,579 | 8/1905 | Gillette | 53/339 |
| 2,409,788 | 10/1946 | Osborne | 53/488 |
| 3,323,276 | 6/1967 | Thomas | 53/488 |
| 3,631,650 | 1/1972 | Leftault, Jr. | 53/488 |
| 4,221,105 | 9/1980 | Guest | 53/334 X |

*Primary Examiner*—Horace M. Culver
*Attorney, Agent, or Firm*—Roland T. Bryan

[57] ABSTRACT

In applying to an externally threaded bottle neck an unthreaded metal closure having a gasket within it, the closure shell is pressed down on the bottle and while the shell is so held the diameter of the upper end of the skirt is reduced at angularly spaced intervals to press the gasket into sealing engagement with a cylindrical sealing surface on the neck of the bottle above the bottle thread and simultaneously to form a band of knurling which can be grasped manually.

13 Claims, 7 Drawing Figures

METHOD OF APPLYING CLOSURES TO CONTAINERS

Figure 3:
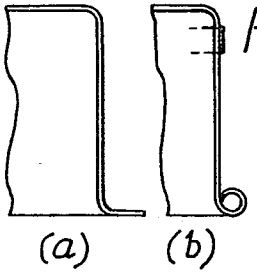

This application is a continuation of application Ser. No. 42,409, filed May 25, 1979 and now abandoned.

The present invention relates to closures for containers e.g. bottles and in particular it relates to a novel method and apparatus for applying reformable closures to bottles and like containers having an externally threaded neck, in such a manner as to form a pressure-holding seal between the cap and the container.

It has been known for many years to apply an unthreaded cup-shaped closure to an externally threaded bottle by placing the closure over the bottle mouth and rolling the unthreaded skirt of the closure into conformity with the thread of the bottle neck while at the same time applying pressure to the top of the closure to hold its gasket against the top end surface surrounding the bottle mouth.

This method of providing bottle caps, which are threaded in situ, was subsequently developed to provide pressure-holding caps capable of withstanding pressures up to 12 atmospheres or even higher by forming a seal between a plain cylindrical surface lying on the bottle neck above the threads and a soft, somewhat flowable gasket in the closure. This method involved a general reduction in the diameter of the upper end of the closure skirt in the course of applying the closure to the container so as to squeeze the gasket material against the cooperating surface on the bottle. This was very advantageous because in practice the nominally cylindrical surface on a glass bottle is frequently slightly elliptical and the actual dimensions of the surface are subject to slight variations as the dies of the bottle-making machines become worn.

The reduction of the diameter of the closure skirt was achieved by means of a plain cylindrical or slightly tapered throat which cooperated with a pressure block applying pressure to the closure. The throat pressed down against the periphery of the top of the closure, thus reducing the diameter of the closure top and reforming the upper end of the skirt into a correspondingly reduced diameter portion, which pressed the gasket material firmly against the side sealing surface on the bottle.

The gasket in the closure shell has had a variety of shapes, usually resulting from the method employed in forming it. In some instances there has been a somewhat triangular (in section) thickened portion in the angle between the top and the skirt of the closure. In other instances the gasket has been shaped in situ by means of a punch so as to present a somewhat cylindrical or conical internal surface to be brought into engagement with the side sealing surface on the bottle by the reforming operation. In gaskets of the latter type in some instances the outer periphery of the gasket has been spaced away from the surrounding area of the closure skirt, particularly where the flowability of the gasket material is rather low. In yet other instances the gasket has been formed from a flat tape of sealing material. The method of the present invention is applicable to closures having these various types of gaskets.

To enable the closure cap to be unscrewed conveniently it is essential to provide knurling on the cap to permit it to be grasped for application of sufficient manual torque to overcome friction forces.

In the system of applying pressure-holding closure caps mentioned above it is the practice to form a band of knurling in the skirt adjacent the rounded corner joining the top to the skirt. After application this band of knurling lies between the top of the thread and the reduced diameter portion at the top of the closure skirt. The method of application makes it obligatory for the band of preformed knurling to be separate from the part of the skirt surrounding the layer of gasket material to be pressed against the side sealing surface on the bottle neck during the reforming operation.

Other closures employ thick compressible liners which cover the entire inner surface thereof as illustrated for instance, in U.S. Pat. No. 3,361,650 to Charles J. Leftault. In application these closures are loosely fitted over the threaded bottle neck and subsequently a cap head is moved downward over the closure to draw the closure downward and to deform the closure skirt radially inwardly to impress the bottle threads in the liner material to form a seal. These closures required full length liners to provide adequate sealing as well as additional liner material to secure the closure to the container neck.

A more historic form of closure, illustrated for instance in U.S. Pat. No. 2,409,788 to A. G. Osborne, employs a specially configured upper closure portion which provides extra metal for the formation of an essential annular reinforcing rib which receives an oversized incompressible liner disc. In application the annular rib is reformed to bend the liner against the container mouth and the wire edge of the lower closure skirt is forced against the container bead to secure the closure to the container. Such process is undesirable because the increased working can lead to a higher incidence of breakage.

While these and other closures are known in the art, none has specifically addressed the problem of providing an inexpensive closure which is readily applied to a bottle with a minimum of processing.

We have now appreciated that important advantages can be achieved by applying an unthreaded closure which has no band of knurling at the top end of the skirt. In the method of the present invention the reforming of the top end of the skirt is effected by means of an internally fluted throat member which reforms the upper end of the skirt to squeeze the gasket material against the sealing surface and simultaneously forms knurling in the upper end of the skirt. The side seal between the gasket material and the bottle neck is thus formed radially inwardly of the band of knurling. In this operation the fluted throat is preferably constructed in such a way that its inner surface is generally circular, interrupted at frequent intervals by cut-outs, which extend over approximately half the periphery of the throat. In one example the circular internal surface was formed by sixteen lands, each extending over 10°–15° of the periphery, each pair of lands being separated by a cut-out of similar angular extent, so that the closure is inwardly deformed through 160°–250° of its periphery. This arrangement was found to provide an adequately coarse band of knurling for manual grasping while at the same time providing enough compression of the gasket material to form a secure pressure-holding seal with the bottle neck. In this particular example the throat was slightly tapered internal diameter of the throat at the lands exceeded the nominal maximum diameter of the bottle sealing surface (within the normally permissible range of tolerances) by about 0.85 mm.

The invention provides different advantages according to the manner by which it is put into effect. The invention may be applied to sealing bottles designed to a pre-existing standard in which there is a cylindrical sealing surface of a specified vertical extent above the threads on the bottle neck. In this case the invention may be employed to apply a band of knurling of greater vertical extent than that previously employed in this position. Alternatively it allows the bottle to be redesigned with a reduction in the vertical extent of the cylindrical side sealing surface.

In closure of this type it is usual to provide an outwardly curled bead at the lower margin of the skirt to avoid the possibility of the user cutting fingers on a sharp metal edge. In order to promote maximum economy in metal use we described a closure in British Pat. No. 1379573 in which a band of knurling was formed in the outwardly curled bead to supplement a rather narrow band of knurling at the top of the skirt between the thread and the reduced diameter portion. The use of the present invention allows a broader band of knurling to be formed above the thread, making the supplementary lower band of knurling unnecessary.

The method of forming knurling in situ in accordance with the present invention is very conveniently and preferably employed with a closure having no outwardly curled bead, since this allows great economy in the use of metal in the closure shell. It is however also very conveniently employed with a closure having a conventional curled bead but no preformed band of knurling.

It is possible to apply a closure, having no outwardly curled bead, to a bottle without much subsequent risk to the users fingers if, in the course of application, the bottom edge of the closure skirt is rolled into close conformity with the bottle. In conventional application of this class of closure the thread is formed by use of thread rollers which deform the metal lying between adjacent thread formations on the bottle. These thread rollers engage the closure skirt near the top and run out at the bottom of the thread groove. Where the rollers run out at the bottom of the skirt of a closure having no reinforcing bead at the bottom edge, the bottom margin of the skirt tends to flare outwardly.

It has already been proposed to meet this problem by providing a plain portion of lesser diameter on the underside of the thread roller, so that as the operating profiled portion of the thread roller follows the groove between two bottle threads, this plain portion follows the crest of the lower of the two threads and acts as a means for restraining outward flaring of the bottom margin of the closure in the region where the thread roller runs out of the groove.

In our co-pending Patent application No. 42,408, now U.S. Pat. No. 4,221,105, the problem is approached in a rather different way by employing a separate plain roller which presses against the full height of the portion of the skirt in which the thread is formed and is angularly displaced from the thread roller. The effect of this plain roller is to follow the profiled thread roller and to press the metal down against the crests of the thread formations on the bottle. In normal thread rolling operation the metal of the skirt tends to billow upwardly over the crests of the threads. Subsequently rolling by means of a plain roller compacts this billowing and produces better conformity of the thread in the skirt wall with the thread formations on the bottle.

Either of the above methods of controlling the bottom margin of a closure shell having no curled bead may be conveniently employed in conjunction with the method of forming knurling in accordance with the invention.

The method of the invention is applicable also to closures of the pilferproof type, in which a severable security band is provided at the bottom margin of that closure skirt.

Figure 1:
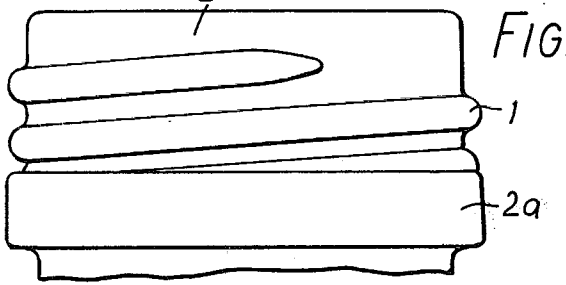
Figure 2:
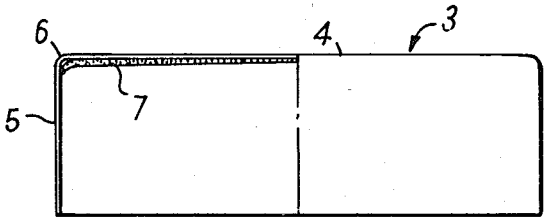
Figure 4:
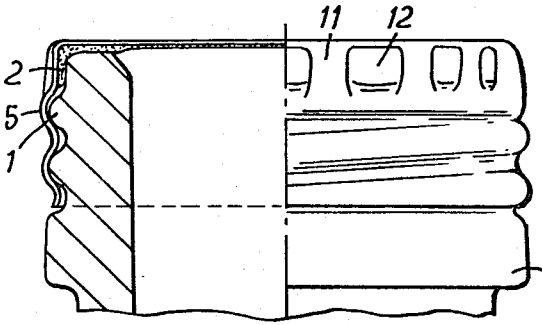
Figure 5:
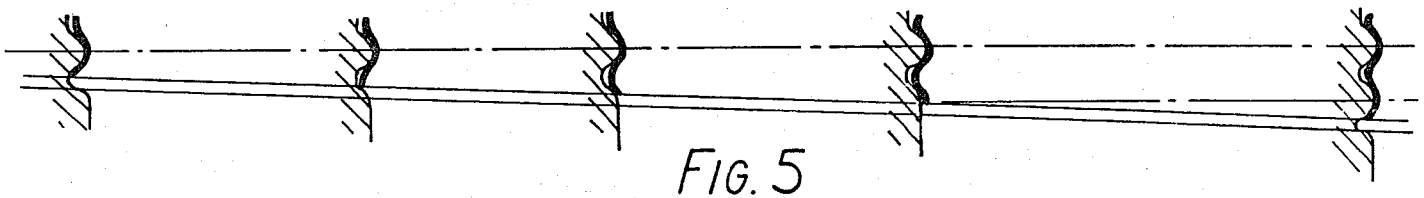
Figure 6:
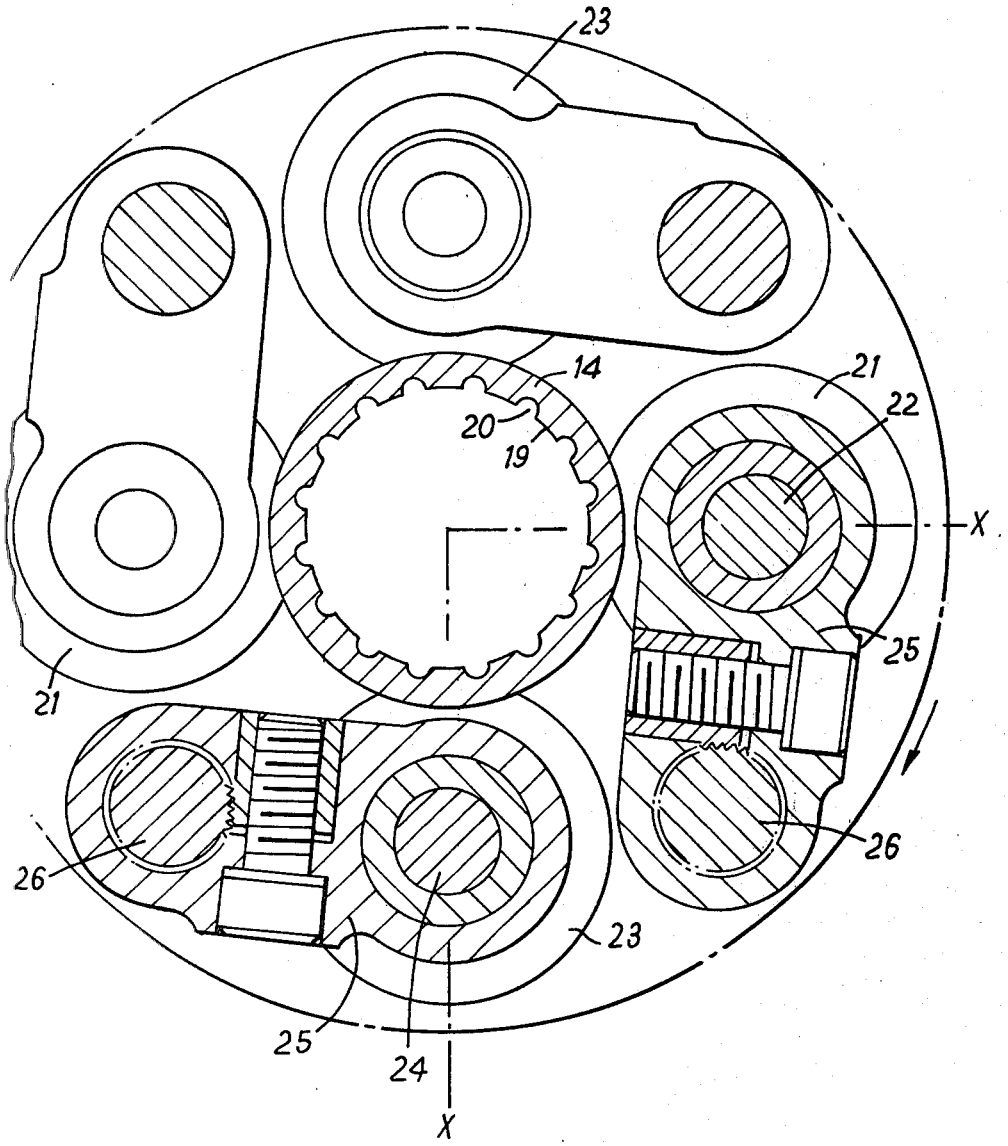
Figure 7:
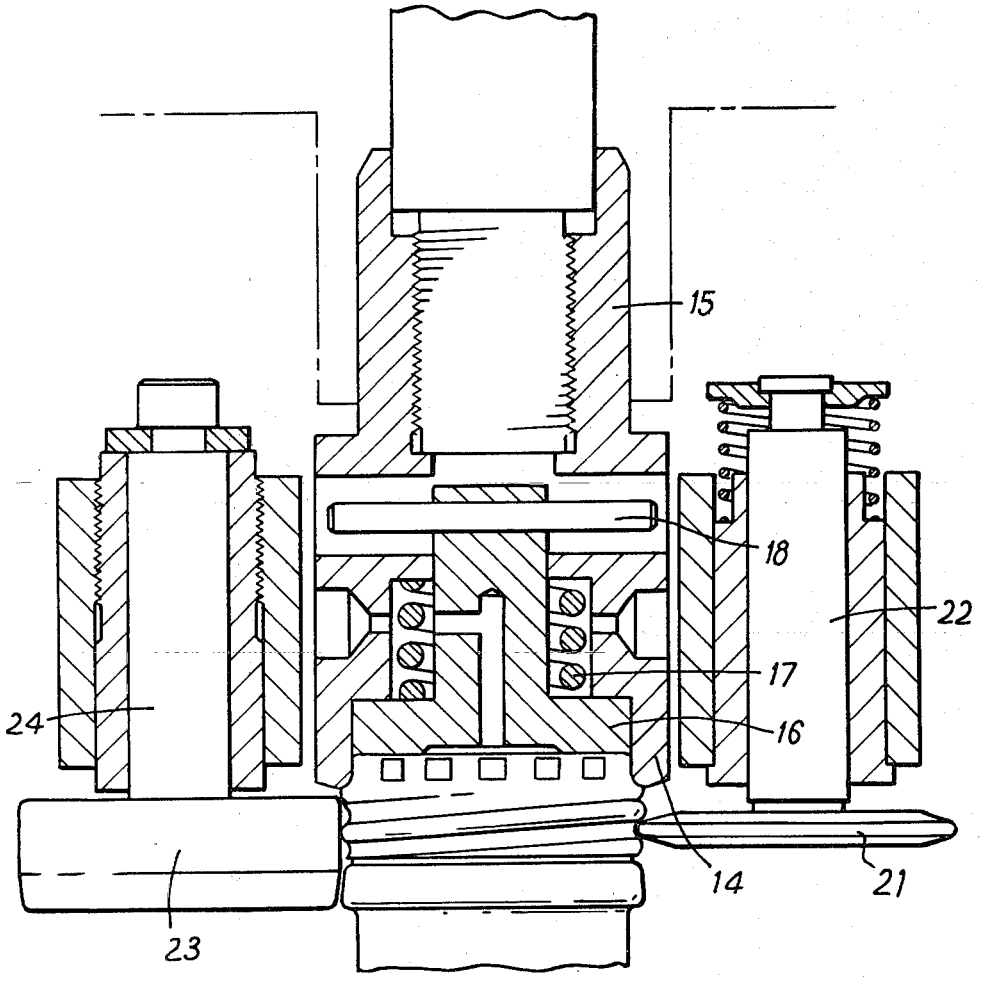

Referring now to the accompanying drawings:

FIG. 1 illustrates the neck of one standard bottle;

FIG. 2 is a part section of an unbeaded closure for application by the method of the invention, FIG. 3 is a part section of a comparable pre-knurled closure with beaded edge (a) before formation of the bead and knurling (b) as ready for application to a bottle, FIG. 4 is a part section of the bottle and closure of FIG. 2 after application, FIG. 5 is a development of the lower margin of the bottom edge of the closure in relation to the container thread, FIG. 6 is a semi-diagrammatic cross section of the tool set, and FIG. 7 is a section on line X—X of FIG. 6.

The bottle neck shown in FIG. 1 has a screw thread formation 1 and a cylindrical sealing surface 2 above.

In the method of the invention the bottle is sealed by application of the very simple closure shown in FIG. 2. It represents a radical departure from conventional practice in not having any preformed knurling in the skirt. The closure is a cup-shaped pressing having a metal shell 3, comprising a top 4 and a cylindrical skirt 5 which meet at a radiused corner 6. The closure is completed by a body of gasket material 7, which is somewhat thickened at or near the radiused corner 6. The gasket may however take any of the alternative forms previously discussed. The shape of the gasket may be produced by a spinning technique or by moulding by means of a punch or forming by any other technique known in the art for this purpose.

In the course of application the closure is changed to the shape shown in FIG. 4, in which it can be seen that a band of knurling has been formed at 11 in the skirt 5 and at the bottom of each knurl depression 12 the gasket material is compressed against the sealing surface 2.

Reference to FIGS. 6 and 7 shows the forming throat 14, which is integral with a body 15 for securing to the sealing head of a sealing machine of known construction. The throat 14 has a presser block 16 slidably mounted thereon and loaded by means of a heavy spring 17. The outward movement of the presser block is limited by stop pin 18 in the conventional manner.

The construction of the forming throat is illustrated in FIG. 6 and it will be seen that, in section, it is comprised of a series of lands 19, which are separated by semi-circular recesses 20 of approximately equal angular extent as the lands 19 in relation to the axis of the throat. The downward movement of throat member 14 over the closure supported on a container produces a band of knurling as illustrated in FIG. 6, while the yielding presser block presses the closure firmly against the top of the container.

It will be seen from FIGS. 6 and 7 that the tool set includes a pair of diametrically opposed conventional profiled thread rollers 21, each mounted on a spring-loaded spindle 22 which allows downward movement of the roller in conventional manner as the roller follows the groove between adjacent turns of the bottle thread. At 90° to the thread rollers 21 there are a pair of diametrically opposed plain rollers 23 each mounted for rotation on a spindle 24. The spindles of the rollers 21 and 23 are respectively carried by lever arms 25 which are keyed to spindles 26 for limited arcuate movement to bring the rollers into engagement with the skirt at the commencement of the thread rolling operation and for disengagement from the bottle in the known way at the completion of the thread rolling operation.

It will be noticed from comparison of FIG. 2 and FIG. 3(*a*) that the vertical extent of the closure is significantly smaller, because in the case of a conventional closure the bead lies over the ring 2*a* on the bottle neck below the thread 1, where it is unaffected by the operation of the thread rollers. Further comparison with FIG. 3(*a*) will show that the blank from which the shell of the closure of FIG. 2 is formed, employs a very significantly smaller amount of metal in the closure skirt by reason of the absence of a curled bead and therefore, for a closure of the same diameter, starts from a significantly smaller diameter flat disk.

It should also be noted that because of the billowing of the metal over the crest of the thread formation, the subsequent flattening by the following plain roll of the billowed metal results in the metal at the bottom margin of the skirt conforming closely to the periphery of the neck, thus greatly reducing the risk of cut fingers on first opening the bottle.

I claim:

1. A method of applying an unthreaded metal closure to an externally threaded bottle neck which comprises placing a cup-shaped metal closure over the mouth of a bottle, applying pressure to the top of the closure shell to press a gasket within the shell firmly against the mouth of the bottle, and rolling thread in the skirt of said shell while so held characterised in that the diameter of the upper end of the skirt is reduced at angularly spaced intervals to press said gasket into sealing relationship with a cylindrical sealing surface on the neck of the bottle above the bottle threads and simultaneously to form a band of knurling for manual grasping.

2. A method according to claim 1 in which the diameter of the upper end of the closure skirt is reduced at a plurality of spaced locations the 360° around its periphery, the inward deformation totalling 160°–250° of the said periphery.

3. A method according to claim 1 in which the angular extent of the inward deformation at each location is in the range of 10°–15°.

4. A method according to claim 1 in which the unthreaded closure has a plain cylindrical skirt without preformed knurling and has a bead-free lower margin, further including the step of restraining the lower margin of the closure skirt against billowing during the formation of thread therein by means of plain rollers engaging the skirt at the axial location of the formation of the thread.

5. A method according to claim 1 further including applying a radially inward force to the portion of the closure skirt overlying the bottle thread simultaneously with the formation of the bottle thread.

6. A tool set for the application of a closure to a container, said closure having a sealing gasket and a skirt, said container having an externally screw-threaded neck and a cylindrical sealing surface between the screw-thread and the mouth of the neck, comprising:

means for applying pressure to the top of the closure to hold the sealing gasket firmly against the mouth of the neck;

means for rolling thread in the skirt of the closure while the sealing gasket is held firmly against the mouth of the neck; and means for reducing the diameter of the closure in the vicinity of the sealing gasket at angularly spaced intervals to press the gasket into sealing relationship with the cylindrical sealing surface of the neck.

7. In a method of applying a deformable cup-shaped metal closure to a bottle, wherein said closure has a top and a dependent plain cylindrical skirt with a lower bead free margin and a flexible sealing gasket inside of said top, said closure being arranged to be applied to said bottle neck having an upper cylindrical sealing surface above the bottle thread, the improved method comprising placing said closure over said threaded bottle neck, applying pressure to said closure top pressing said gasket firmly against the top and surface of said bottle neck and, while said closure is so held down, reducing the diameter of the upper end of said skirt at angularly spaced intervals to press said gasket into sealing relationship with said cylindrical sealing surface on said bottle neck above said bottle threads and simultaneously forming a band of knurling for manual grasping, and rolling thread in said skirt of said closure by applying a radially inward force to the portion of said closure skirt overlying said bottle thread and simultaneously restraining said lower margin of said closure skirt against billowing during the formation of thread therein by means of plain cylindrical rollers engaging the part of the skirt being threaded.

8. A method according to claim 7, wherein said reducing the diameter is effected at a plurality of spaced locations around the 360° of the periphery of said upper end of said closure skirt producing inward deformation totaling 160°–250° of said periphery.

9. A method according to claim 7 wherein said reducing the diameter produces inward deformation at a plurality of locations, the angular extent of said deformation at each of said locations being in the range of 10°–15°.

10. In a method of applying a deformable cup-shaped closure blank to a bottle, wherein said closure blank has a top and a dependent plain cylindrical skirt and a flexible sealing gasket inside of said top, said closure being arranged to be applied to said bottle neck having an upper cylindrical sealing surface above the bottle thread and a mouth defined by the top end surface of said neck, the improved method comprising placing over the mouth of said bottle said closure, pressing said top of said blank down on to said top of said bottle and simultaneously deforming inwardly, at a multiplicity of circumferentially spaced locations only those radially outer cylindrical surface portions of said blank immediately adjoining said mouth of the bottle to seal said bottle and, whilst maintaining said downward pressure on said top of said blank, using thread rollers to roll said skirt of said closure blank into conformity with said screw-thread on said bottle neck.

11. In a method of applying a deformable cup-shaped metal closure to a bottle, wherein said closure has a top and a dependent plain cylindrical skirt and a flexible sealing gasket on the underneath surface of said top, said closure beig arranged to be applied to said bottle neck having an upper cylindrical sealing surface above the bottle thread, and a mouth defined by the top end surface of said neck, the improved method comprising placing said closure over said bottle mouth pressing said top of said blank down on to said bottle and simultaneously deforming inwardly, at a multiplicity of circumferentially spaced locations only those radially outer cylindrical surface portions of said blank immediately adjoining said mouth of said bottle to seal said bottle and, whilst maintaining said downward pressing on said top of said blank, using thread rollers to roll said skirt of said closure blank into conformity with the screw-thread on said bottle neck and rolling said skirt in a manner non-deforming to the skirt against said bottle neck by means of plain cylindrical rollers disposed at the location where the screw-thread is being formed and circumferentially intermediate said thread rollers, thereby to restrain billowing of the skirt between the thread rollers.

12. In a method of applying a deformable cup-shaped metal closure to a bottle, wherein said closure has a top and joined thereto in a radiused corner, a dependent plain cylindrical skirt and a flexible sealing gasket inside of said top having a thickened region in the angle between the cylindrical skirt and the top, said closure being arranged to be applied to said bottle neck having an upper cylindrical sealing surface above the bottle thread and a mouth defined by the top end surface of said neck, the improved method comprising placing said closure blank over said neck of said bottle pressing said top of said blank down on to said top of said bottle and simultaneously deforming inwardly, at a multiplicity of circumferentially spaced locations only those radially outer cylindrical surface portions of the blank immediately adjoining said mouth of the bottle to seal said bottle and, whilst maintaining said downward pressure on said top of said blank, using thread rollers to roll said skirt of said closure blank into conformity with the screw-thread on the bottle neck.

13. In a method of applying a deformable cup-shaped metal closure to a bottle, wherein said closure has a top and a dependent plain cylindrical skirt with a lower bead free margin and a flexible sealing gasket on the underneath surface of said top, said closure being arranged to be applied to said bottle neck having a upper cylindrical sealing surface above the bottle thread and a top defining a mouth, the improved method comprising placing said closure over said mouth of said bottle, pressing said top of said blank down on to said top of said bottle and simultaneously deforming inwardly, at a multiplicity of circumferentially spaced locations, only those outer cylindrical surface portions of the blank immediately adjoining said mouth of said bottle to seal said bottle, and whilst maintaining said downward pressure on the top of the blank using thread rollers to roll said skirt of said closure blank into conformity with said screw-thread on said bottle neck and simultaneously rolling said skirt against said bottle neck in a manner non-deforming to the skirt by means of plain cylindrical rollers disposed at the location where the screw-thread is being formed and circumferentially intermediate said thread rollers, thereby to restrain billowing of said skirt between said thread rollers.

* * * * *